US010190331B2

(12) United States Patent
Delafield et al.

(10) Patent No.: US 10,190,331 B2
(45) Date of Patent: Jan. 29, 2019

(54) MODULAR RAILING SYSTEMS WITH CELLULAR PVC PANELS

(76) Inventors: Warren Delafield, Roanoke, VA (US); Roger D. Clark, Jr., Bumpass, VA (US); Jeffrey Delafield, Roanoke, VA (US)

( * ) Notice: Subject to any disclaimer, the term of this patent is extended or adjusted under 35 U.S.C. 154(b) by 878 days.

(21) Appl. No.: 12/698,554

(22) Filed: Feb. 2, 2010

(65) Prior Publication Data

US 2010/0283022 A1 Nov. 11, 2010

Related U.S. Application Data

(60) Provisional application No. 61/149,545, filed on Feb. 3, 2009.

(51) Int. Cl.
*E04H 17/14* (2006.01)
*E04H 17/16* (2006.01)
*E04F 11/18* (2006.01)

(52) U.S. Cl.
CPC ..... *E04H 17/16* (2013.01); *E04F 11/1851* (2013.01)

(58) Field of Classification Search
CPC ..... E04H 17/168; E04H 17/16; E04F 11/1851
USPC ..... 256/12.5, 19, 24, 25
See application file for complete search history.

(56) References Cited

U.S. PATENT DOCUMENTS 3,411,753 A * 11/1968 Wood ..... 256/24
4,124,093 A * 11/1978 Breisch ..... 182/186.5
4,141,944 A * 2/1979 Anstadt et al. ..... 264/45.5
4,586,697 A * 5/1986 Tornya ..... 256/65.11
4,690,383 A * 9/1987 Batcheller ..... 256/24
4,959,107 A * 9/1990 Wallick et al. ..... 148/566
5,078,367 A * 1/1992 Simpson et al. ..... 256/24
5,155,963 A * 10/1992 Woodman ..... 52/656.8
5,418,021 A * 5/1995 Kim ..... 428/14
5,494,715 A * 2/1996 Glover ..... 428/34
5,555,692 A * 9/1996 Griffith ..... 52/662
6,029,954 A * 2/2000 Murdaca ..... 256/59
6,311,455 B1 * 11/2001 Gerard ..... 52/786.1
6,719,277 B2 * 4/2004 Ohanesian ..... 256/19
6,761,946 B2 * 7/2004 Corapi ..... 428/38
6,868,596 B2 * 3/2005 Reichert ..... 29/407.05
(Continued)

*Primary Examiner* — Josh Skroupa
*Assistant Examiner* — Matthew R McMahon
(74) *Attorney, Agent, or Firm* — New River Valley IP Law, P.C.; Michele L. Mayberry

(57) ABSTRACT

The present invention relates to the field of railing and fencing systems. More particularly, embodiments of the present invention relate to modular railing/fencing systems comprising extruded aluminum railings with cellular polyvinyl chloride (PVC) panel inserts having an impact resistance of up to about 350 lb/ft$^2$, which combined provide a system capable of withstanding significant external forces. Particular embodiments of the invention include modular fencing systems comprising: a) one or more upright vertical post members; b) upper and lower horizontal guardrails with a longitudinal panel-receiving channel; c) one or more cellular polyvinyl chloride (PVC) panel inserts operably configured for insertion in the panel-receiving channels of the upper and lower guardrails; d) wherein, upon installation, the system is capable of receiving a load normal to the panel ranging from about 180 to about 360 lb/ft$^2$ without failure. Cellular PVC panels for use in such systems are also included.

17 Claims, 15 Drawing Sheets

(56) References Cited

U.S. PATENT DOCUMENTS

| | | | | |
|---|---|---|---|---|
| 7,278,241 | B2 * | 10/2007 | Wirawan | 52/203 |
| 7,318,301 | B2 * | 1/2008 | Reeder et al. | 52/204.61 |
| 7,635,114 | B2 * | 12/2009 | Laws et al. | 256/19 |
| 7,681,369 | B2 * | 3/2010 | Soltesiz et al. | 52/456 |
| 7,857,291 | B2 * | 12/2010 | Dombroski | 256/24 |
| 2002/0011594 | A1 * | 1/2002 | DeSouza | 256/19 |
| 2004/0206948 | A1 * | 10/2004 | Lappen | 256/65.03 |
| 2005/0191466 | A1 * | 9/2005 | Andrade | 428/167 |
| 2006/0175594 | A1 * | 8/2006 | Burkart et al. | 256/65.02 |
| 2006/0284154 | A1 * | 12/2006 | Sprague | 256/59 |
| 2007/0224885 | A1 * | 9/2007 | McCarthy | 439/608 |
| 2007/0278468 | A1 * | 12/2007 | Zacarias et al. | 256/24 |
| 2008/0277639 | A1 * | 11/2008 | Huang | 256/24 |
| 2009/0152523 | A1 * | 6/2009 | Erwin | 256/24 |

* cited by examiner

MODULAR RAILING SYSTEMS WITH CELLULAR PVC PANELS

CROSS-REFERENCE TO RELATED APPLICATIONS

This application relies on the disclosure and claims the benefit of the filing date of U.S. Provisional Patent Application No. 61/149,545 filed Feb. 3, 2009, the disclosure of which is herein incorporated by reference in its entirety.

BACKGROUND OF THE INVENTION

Field of the Invention

The present invention relates to the field of railing and fencing systems. More particularly, embodiments of the present invention relate to modular railing/fencing systems comprising extruded aluminum railings with cellular polyvinyl chloride (PVC) panel inserts having an impact resistance of up to about 350 lb/ft$^2$, which combined provide a system capable of withstanding significant external forces (FIG. 1).

Description of the Related Art

Existing commercially available railings and fencing systems are fabricated from a wide range of various materials and configurations, including wooden or plastic fences with posts, railings, and pickets, lattice-like (grid-like) panels; chain link fences; and wire fences (e.g., barbed wire or electric), to name a few. Typically, such materials and configurations require time consuming and labor intensive on-site construction.

To reduce installation time and labor costs, pre-formed panels of fence-forming materials have been provided. For example, a snow fence formed of fence panels composed of rectangular wood frames with plastic mesh material stretched with a tension of 950 pounds within the frame and between reinforcing steel bars has been disclosed. Such a fencing system, however, is not appropriate for most residential or commercial projects because of the cost, weight, and overall appearance of the materials used.

Also provided previously are fencing systems with vertical posts and a continuous, flexible, plastic barrier netting. Such fencing systems lack strength and versatility for different applications and do not meet high-end type expectations of the most discerning clients. Other known pre-formed panels are costly to manufacture or install, involve multi-step processes for constructing the panels within a frame, involve difficult frame joining processes, are aesthetically unacceptable, offer little flexibility or modularity, or are unable to withstand significant environmental and other external forces.

Others have experimented with combinations of materials to increase strength of the overall installed product and in particular in the context of plastic and vinyl fencing options. Plastic and vinyl fencing have become popular alternatives to traditional wood and steel fencing in that plastic and vinyl fencing is often less costly, easier to install, and often require less maintenance. Plastic and vinyl fencing typically include pre-fabricated post and rail components that are easily assembled. It has been realized, however, that plastic and vinyl fence posts, are not designed to support great amounts of weight, such as even that required for a traditional gate within the fencing system. To compensate for this inadequacy, consumers are therefore forced to select traditional materials, such as steel and wood, for portions of the fencing system that may require stronger materials. For example, some have provided steel or aluminum posts, railings, and pickets with an overlay/wrapping of a thin sheet of vinyl to take advantage of the strength of the metal and the maintenance-free benefit of the vinyl simultaneously. These combinations, however, are inadequate in that the vinyl encasement often moves back and forth on the metal (typically a consequence of the differing expansion/contraction rates of different materials) resulting in unfavorable squeaking sounds or safety concerns during use. Further, combining traditional materials with the plastic fence in this way provides an undesirable appearance and is contrary to the benefits provided by plastic and vinyl.

Indeed, modular railing systems that make use of aluminum rail and post components have been in use for a number of years. The advantages of these systems over traditional wood or steel railing systems are well known. Aluminum railings are relatively lightweight, inexpensive, do not rust, and can be painted in any desirable color. As disclosed in U.S. Pat. No. 4,968,005, which is incorporated herein by reference in its entirety, railing systems may comprise hollow (e.g., tubular) aluminum rails formed with channels to receive the upper and lower ends of pickets. A schematic representation of a picket-type railing with channels for receiving the pickets is shown in FIG. 2A.

Picket-type railing systems, however, typically require screws for attaching each picket to the bottom or top rail. FIG. 2B is a schematic diagram illustrating means by which typical prior art railing systems (e.g., U.S. Pat. No. 7,472,482) are usually constructed. As shown, the screws securing the pickets to the bottom rail are inadequate in that over time, or by way of external vibrations imposed on the system, or by way of thermal changes in the materials when exposed to changing weather, the screws will become loose leading to a decrease in strength, safety, and/or security abilities of the system.

Likewise, it is known that glass panels in combination with pickets can also be inserted into the channels of this type of railing as is demonstrated for example in U.S. Pat. No. 5,200,240, which is incorporated herein by reference in its entirety, and shown in FIG. 3A. One limitation of this glass panel and picket system, however, is that an additional support feature is needed to support the glass panel against potential external forces that are expected during use, as shown in FIG. 3B.

Guardrails with glass, wood, metal, or non-metal protective boards are also known, such as that provided in U.S. Pat. No. 7,017,320, which is herein incorporated by reference in its entirety. Such guardrails are typically comprised of two parallel metal tubes with a protective wood board mounted in between. Even further, vertical panel glass walls of different configurations are also known. None of these fencing or railing systems disclosed in the art, however, purport to have sufficient strength to be capable of withstanding significant external forces exerted against the panels during use after installation of the products.

Thus, what previous attempts have failed to do and what is desperately needed are fencing/railing systems that are all-in-one economical, aesthetically pleasing, easy to install, virtually maintenance free, and capable of withstanding significant external forces during use.

SUMMARY OF THE INVENTION

The present invention addresses the above-described issues by providing insert panels (sometimes referred to herein as "in-fill panels") formed from cellular PVC. These panels are configured to fit between the upper and lower rails of existing modular rail systems, but, unlike prior art inserts or pickets, may be formed with intricate patterns or designs to provide a highly decorative, virtually maintenance free, yet high strength railing system.

One object of this invention is to provide a lightweight fencing structure which may be readily assembled from standard components to provide an attractive yet multi-functional fencing system.

Embodiments of the invention include modular fencing systems comprising: a) one or more upright vertical post members; b) upper and lower horizontal guardrails with a longitudinal panel-receiving channel; c) one or more cellular polyvinyl chloride (PVC) panel inserts operably configured for insertion in the panel-receiving channels of the upper and lower guardrails; d) wherein, upon installation, the system is capable of receiving a load normal to the panel ranging from about 180 to about 350 lb/ft$^2$ without failure.

The modular fencing systems of the present invention can be configured to withstand any range of loads exerted upon the system. For example, preferred embodiments can receive a load normal to the panel (in an upright position and approximately at panel center) ranging from about 50-100 lb/ft$^2$, 70-120 lb/ft$^2$, 80-160 lb/ft$^2$, 150-180 lb/ft$^2$, 175-200 lb/ft$^2$, 181-201lb/ft$^2$, 190-250 lb/ft$^2$, 205-220 lb/ft$^2$, 225-300 lb/ft$^2$, 275-340 lb/ft$^2$, 320-400 lb/ft$^2$, 360-450 lb/ft$^2$, 425-525 lb/ft$^2$, and so on up to the ultimate strength provided by the aluminum railing and the cellular PVC panel combination.

Further, the posts and upper and lower guardrails can comprise aluminum having a minimum tensile strength of about 38,000 psi. Preferred embodiments comprise extruded aluminum rails and posts.

Modular fencing systems and panel inserts of embodiments of the invention can comprise cellular PVC material having a tensile strength of about 2,000 to 5,000 psi.

Preferred embodiments of the inventive fencing systems comprise panels having a thickness and the panel-receiving channels of the upper and lower guardrails having a corresponding width to provide for an interference fit between the panel and channel upon insertion of the panel.

A glass panel can be included with the cellular PVC panels, if desired. Using a cellular PVC panel overlaid with a glass panel can provide railing systems with higher strength than by using glass alone and can provide additional safety features to the cellular PVC panels than if used alone. For example, in some embodiments if used in commercial establishments with balconies (such as hotels), it may be desired to combine a sheet of glass between the building and the side (face) of the cellular PVC panel that faces the building to prevent others, especially children, from climbing the panels. The combination provides a see-through look without causing substantial safety concerns. For additional safety, the glass panel can comprise tempered glass. In preferred embodiments, the panel-receiving channel of the upper and lower rails is capable of accommodating the cellular PVC and glass combination panel and optionally additional material, such as a silicone gasket to protect and secure the glass within the channel.

Embodiments also include in-fill panels for modular fencing systems comprising a panel of cellular polyvinyl chloride (PVC) comprising an integral frame and multiple voids in or through a face of the panel, wherein the voids collectively account for less than about 50% of the possible surface area of the face of the panel. In preferred embodiments, the voids account for between 30-50% of the possible surface area of the panel, or between 25-40% of the possible surface area, or between 10-80% of the possible surface area of the panel.

In some embodiments the panels comprise an integral frame, or area of solid material (no cut outs) that is continuous around the perimeter of the panel. Preferably, the integral frame accounts for at least about 10-20% of the possible surface area of the panel face. The integral frame can comprise from 30-50%, or from 60-75%, or from 80-100% of the surface area of the panel, depending on a desired configuration.

The present invention also includes methods for preparing in-fill panels that can be used with modular fencing systems comprising: a) obtaining a solid panel of cellular polyvinyl chloride (PVC) having at least one face with a desired surface area; b) carving or routing at least one void in or through the face of the panel, wherein an integral frame in the face of the panel is formed, which comprises at least about 10-20% of the surface area of the solid panel; and wherein each void has an area, and a ratio of a sum of all void areas to the surface area of the solid panel is less than about 50:50.

DETAILED DESCRIPTION OF VARIOUS EMBODIMENTS OF THE INVENTION

Reference will now be made in detail to various exemplary embodiments of the invention. The following detailed description is presented for the purpose of describing certain embodiments in detail and is, thus, not to be considered as limiting the invention to the embodiments described. Rather, the true scope of the invention is defined by the claims.

Embodiments of the present invention are described herein in relation to a fencing system and structure but one of ordinary skill in the art will recognize that the invention is not limited thereto. For example, variations of the embodiments herein described are possible and can include applications relating to balusters, divider walls, partitions, gates, security enclosures, and any other such structure that may call for a panel-type railing system.

Figure 1:
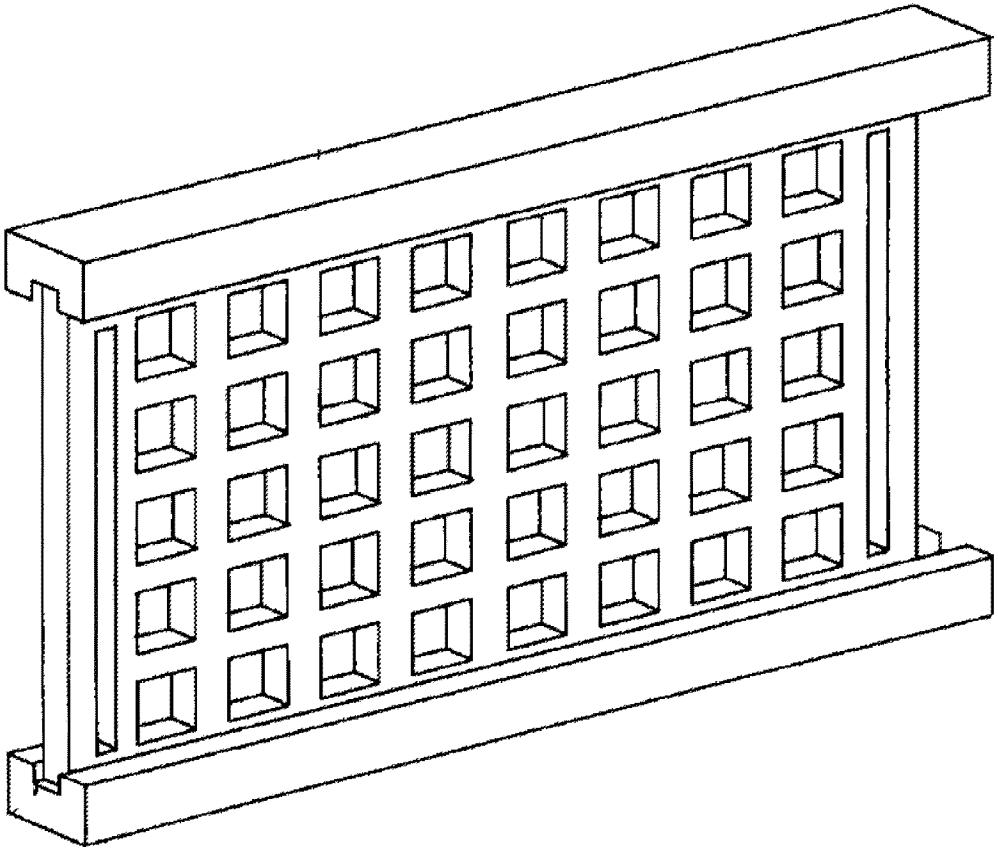
FIG. 1 is schematic diagram illustrating an exemplary railing system embodiment according to the invention, including a panel insert and upper and lower rails.
Figure 2A:
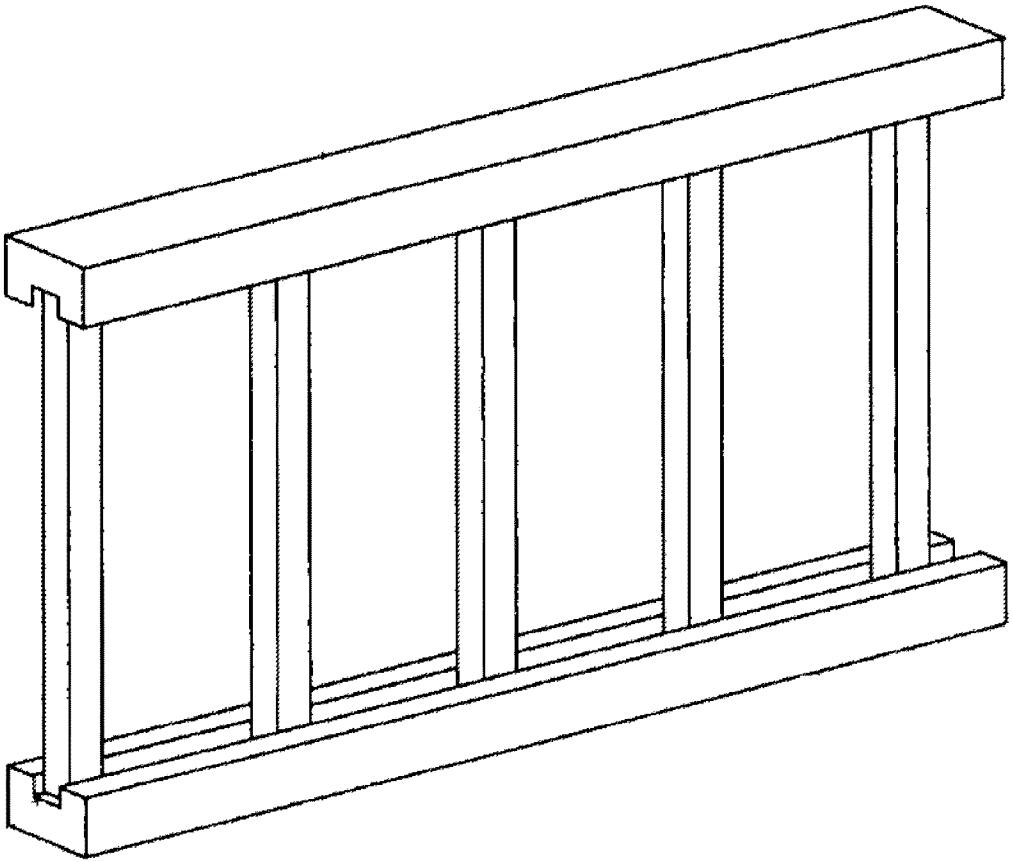
FIG. 2A is a schematic diagram illustrating a typical prior art railing system.
Figure 2B:
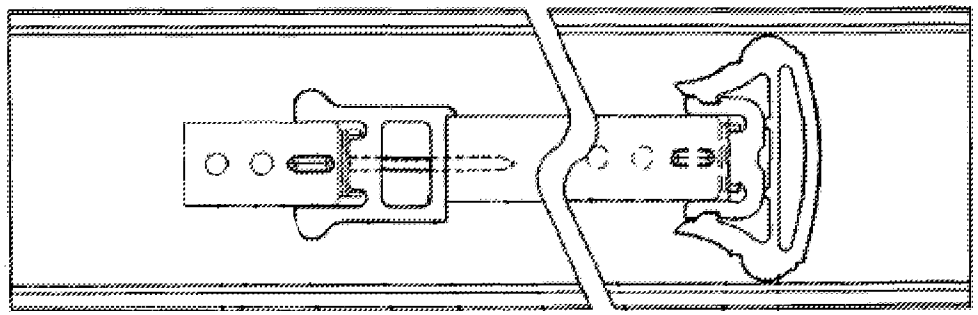
PRIOR ART FIG. 2B
FIG. 2B is a schematic diagram illustrating means by which typical prior art railing systems are usually constructed.
Figure 3B:
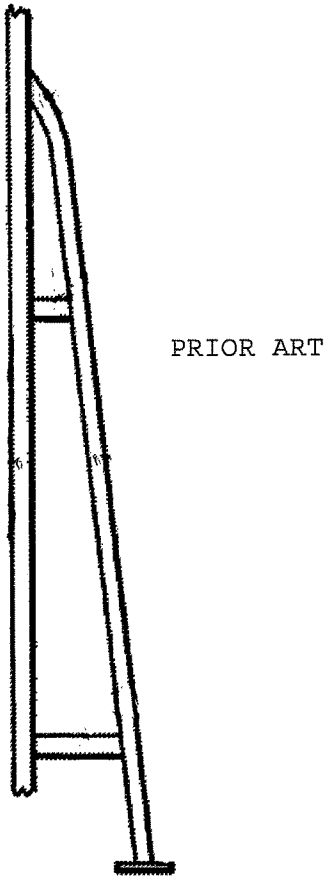
FIG. 3B is a drawing of the support for the railing system shown in FIG. 3A.
Figure 3A:
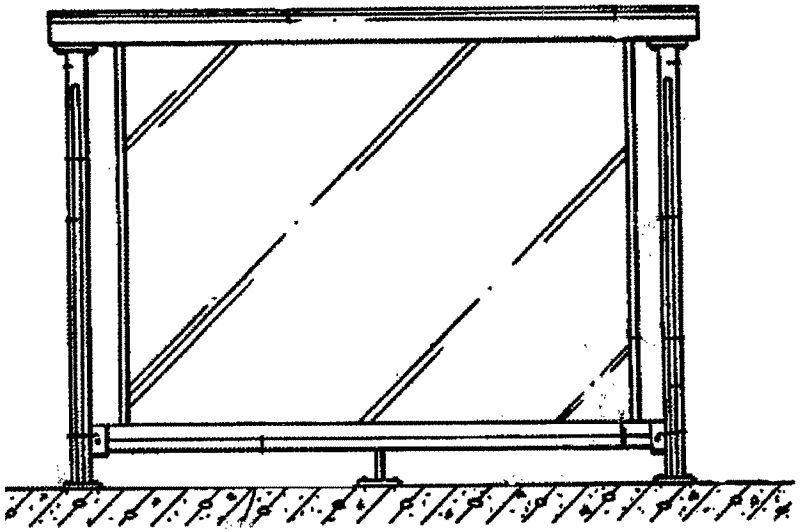
FIG. 3A is a drawing of the railing system disclosed in U.S. Pat. No. 5,200,240.

FIG. 1 is a schematic diagram illustrating an exemplary railing system embodiment according to the invention, including a panel insert and upper and lower rails. As shown, FIG. 1 provides a fencing panel insert comprising a solid sheet of cellular polyvinyl chloride (PVC) with through-hole type cut outs strategically cut in the sheet to provide for an aesthetically pleasing panel having superior strength. Panel inserts, or simply panels, of embodiments of the invention can be any length, width, or thickness. These dimensions can be selected to provide a panel having a desired tolerance for impact resistance.

In this embodiment, the panel is $\frac{5}{8}^{th}$ inch thick, which imparts substantial strength to the panel as well as provides for an interference fit within the $\frac{5}{8}^{th}$ inch wide channels of the upper and lower railings. Other panel thickness can be selected, for example, to provide a snug or loose fit within the corresponding railing channels. Other materials (e.g., silicone strip) can be added between the panels and the railing channel to make up any undesired spacing or to provide for cushioning between the panel and the channel of the railing, or between the cellular PVC panel and a glass panel. The thickness of the panel(s) can be increased or decreased depending on the size of the channel in which the panel(s) are expected to fit and/or depending on the desired amount of impact resistance needed for a particular application. For example, a solid panel of cellular PVC could be provided as a thinner panel than a panel having cut outs, yet both might have the same impact resistance tolerance. If combined with other materials, for example, a panel of glass, it is possible to have a thinner cellular PVC panel, such as $\frac{5}{16}^{th}$ inch, in combination with a $\frac{5}{16}^{th}$ inch of glass, so that the combined panel (with PVC and glass panels overlaid) would fit in a $\frac{5}{8}^{th}$ railing channel. Likewise, if using standard materials such as a $\frac{1}{4}^{th}$ inch thick glass panel, a $\frac{3}{8}^{th}$ inch thick cellular PVC panel could be used and the two panels sandwiched together within the $\frac{5}{8}^{th}$ inch channels of the handrail and bottom rail. If strength of the system and impact resistance are not a high priority for a particular application, such as for decorative use, adjusting the thicknesses of the panel(s) is straightforward, as the only consideration would be fitting the panels in a corresponding support slot of a railing system.

In this embodiment, for added support and strength, the panel insert comprises an integral "frame" along the perimeter of the panel. This "frame" is formed when making the through-hole cut outs in the sheet by making the cut outs at positions other than close to the edge of the panel. An integral frame, or portion of the panel around the panel perimeter, provides additional strength to the panel in comparison to similar panels with no frames, or frames that are not integral to the panel or otherwise a single, continuous piece of material.

For example, a panel can comprise cut outs that are at least a distance of about ½ inch from any edge. Embodiments provided herein, for example, can comprise no cut outs, partial cut outs, or through hole type cut outs that are no closer to the perimeter edge of the panel and/or to one another within the panel than about $\frac{1}{8}^{th}$ inch. Any spacing from each other or the edge can be used, but stronger embodiments are those with no cut outs, partially routed cut outs, smaller cut outs, fewer cut outs, or cut outs farther from the edge or another cut out.

Particular examples include panels where any single cut out is spaced from the edge or another cut out by at least about $\frac{1}{16}^{th}$, $\frac{1}{8}^{th}$, $\frac{1}{4}^{th}$, ½, $\frac{5}{8}^{th}$, $\frac{3}{4}^{th}$, 1, 1.2, $1\frac{1}{4}^{th}$, $1\frac{1}{4}^{th}$, 1½, $1\frac{3}{4}^{th}$, $1\frac{13}{16}^{th}$, $1\frac{7}{8}^{th}$, 2, $2\frac{1}{4}^{th}$, 2½, $2\frac{13}{16}^{th}$, $2\frac{15}{16}^{th}$, 2.93, 3, $3\frac{1}{4}^{th}$, 4, 5, 6 inches, to name a few. Preferably, spacing between cut outs and/or the panel edges provides for at least about 1 or 1.2 inches of cellular PVC material, and most preferably about 1½ inch of material. Likewise, an increase in size and/or number of cut outs will also decrease strength of the panel. In preferred embodiments, the surface area of the front or back side (face) of a panel comprises at least 30% material and 70% void. More preferably this ratio is at least about 35:65, 40:60, 45:55, 50:50, 60:40, 65:35, 70:30, 75:25, 80:20, 90:10, 95:5 . . . 100:0, but can be lower for some applications, or any ratio in between.

Most preferred embodiments comprise cellular PVC panels about $\frac{5}{8}^{th}$ inch thick, having multiple routed cut outs or carved through holes that amount to no more than about 65% of the surface area of the front side of the panel, and have at least about 1 inch of cellular PVC material between each cut out (whether a complete through hole or partially routed) in the panel.

Another embodiment comprises a cellular PVC panel with a single cut out in the middle of the panel, leaving at least about a 1 or 1.5 inch "frame" configuration. The cut out can be any shape, including rectangular, square, oval, circular, etc. with embodiments being stronger with less material cut away. Such a "frame"-type panel can be overlaid with a glass panel to provide increased strength to a railing system comprising the combination rather than a glass panel alone, yet provide the same or similar aesthetic benefits of using glass alone.

Figure 4:
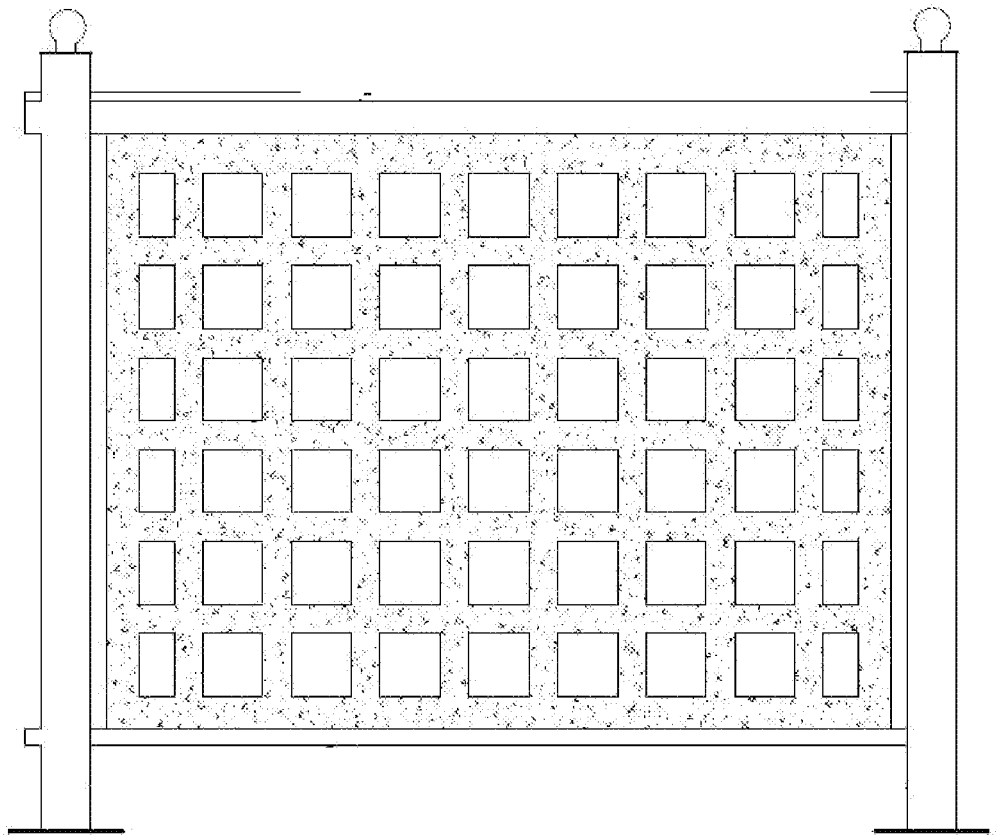
FIG. 4 provides a schematic diagram of a railing system embodiment of the present invention, including a panel insert, upper/lower rails, and side support posts.

FIG. 4 provides a schematic diagram of another embodiment of the present invention. As shown, additional strength can be imparted to the railing systems by further supporting the vertical edges of the panel in corresponding channels of the support posts. In this manner, all four edges of the panel are supported within the aluminum rail and post system by way of panel-receiving channels extending longitudinally through the rails and posts. It is also possible to have the panels received by only the support posts rather than the railings, if desired.

Figure 5A:
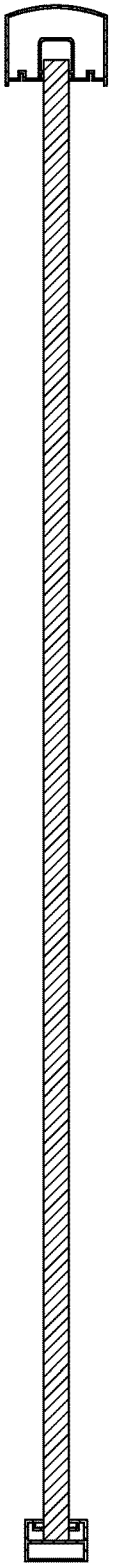
FIGS. 5A, B, and C are schematic diagrams showing an exemplary configuration of a railing that can be used in combination with the panel inserts of the invention.

FIGS. 5A, B, and C are schematic diagrams showing an exemplary configuration of a railing that can be used in combination with the panel inserts of the invention. FIG. 5A is a cross-sectional view of a railing system of this embodiment. Included in the view are top and bottom rails comprising a hollow aluminum configuration and a railing panel insert. Although aluminum railing systems have been found to provide exceptional strength and modularity, any type of railing system can be used with the cellular PVC panels. For example, handrails, bottom rails, and support posts, as well as vertical and horizontal support members for gates, can be made of wood, plastic, vinyl, composites, vinyl with aluminum reinforcement, etc. For example, it may be possible to use materials that have a tensile strength slightly higher than or about the same as the cellular PVC panels being used (instead of a factor of 10, like aluminum), such as solid cellular PVC railings with a panel-receiving channel of a sufficient depth to prevent the panel (when under pressure) from being dislodged from the top and/or bottom rails. It is possible, that a cellular PVC top/bottom rail capable of receiving 2-4 inches of the frame of a cellular PVC panel would satisfy higher design load requirements (180-350 $lb/ft^2$ and up).

A preferred material for the railing systems is a high strength structural aluminum alloy, such as any of the Alcoa Engineered Products'6XXX series alloys, such as alloy 6005-T5, 6061-T6, 6063-T5 etc., with a minimum of about 38,000 p.s.i. ultimate tensile strength. The invention includes preferred railing system embodiments comprising aluminum railing systems by S.T.A.R.® (snap tight aluminum railing) System International, Ltd., which use the 6XXX series type alloys. The aluminum S.T.A.R.® railing system generally is combined with an in-fill area of aluminum materials as well, which are typically aluminum pickets. The aluminum-based in-fill area of the S.T.A.R.® guardrail system is engineered to withstand a horizontal concentrated load of 200 lb applied to one square foot, however, some S.T.A.R.® railing systems exhibit low recovery rate when subjected to substantial pressure.

For example, literature provides for only an 80% recovery of the original position of a rail assembly that was subjected to a load of 100 lb. per lineal foot applied horizontally for a period of five minutes to the top rail of a S.T.A.R.® railing measuring 96 in. from center of post to center of post, 42 in. high from the base to the top of the guardrail, having a top rail diameter of 2.375 in. with a 0.625 in. slot, aluminum ⅝in. ×⅝in. tubular pickets spaced at 4-⅝$^{th}$ in. intervals, support posts comprising 2-¾$^{th}$ in.×2-¾$^{th}$ in. aluminum tubing 0.09 in. thick welded to a ⅜$^{th}$ in. thick aluminum 5 in. ×6 in. base plate, a ¼$^{th}$ in. ×4 in. ×8 in. stiffener within a ¼$^{th}$ in. ×8 in. slot machined through the base of the post and welded to the base of the post and base plate and aligned front to back, the base plate having three ½in. diameter holes equally spaced at either side of each post, and the base plate fastened to concrete with six ½in. ×4 in. wedge anchors.

The thickness of the sides of the aluminum tubing used in the railings and posts can be any thickness, with greater thicknesses providing for maximum strength. For example, 0.050, 0.060, 0.070, 0.080, 0.090, 0.100, 0.110, 0.120, 0.130, 0.140, 0.150 inches, etc. can be used for the thickness of the railings and/or posts, with 0.080-0.120 being highly preferred. Aluminum railings in combination with the cellular PVC in-fill panels described herein provide for complete railing systems capable of withstanding up to and above 350 lb/ft$^2$ of pressure exerted normal to a face of an installed panel at approximately its center.

Figure 5B:
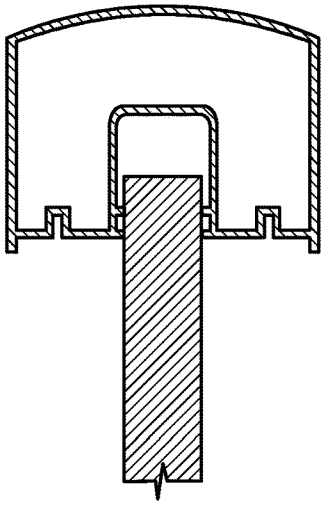
Figure 5C:
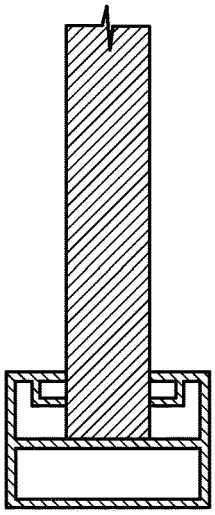

As shown, the railing panel insert is inserted into a panel-receiving channel of each of the top and bottom rails. The dimensions of the top and bottom rails are not critical, so long as the corresponding panel-receiving channels are deep enough to provide sufficient support for the panel. FIG. 5B provides a cross-sectional view of the upper railing in combination with a panel insert. As shown, the panel is inserted into the interior channel of the upper rail and contained in the channel by way of an interference fit. Here, the panel is ⅝$^{th}$ inch thick and the corresponding interior channel of the upper rail comprises an opening of the same dimension. Although the overall channel itself is slightly larger than the panel thickness, the channel comprises abutment members within the channel for contacting the panel upon insertion into the channel. Abutment members are optional and the size of the cavity can also be larger than the thickness of the panel, for example, if additional material inserted in the channel is desired, i.e., a second panel and/or materials for cushioning the contact between the panel(s) and the channel and/or abutments. The depth of the channel is also not critical. The channel can be deeper than the amount of panel inserted (as shown), or can be configured so that the panel contacts the upper interior surface of the channel. It may be desired to have the panel contact as much and as many surfaces as possible within the channel to increase stability of the system. As shown in FIG. 5C, a cross-sectional view of an exemplary bottom railing is provided. Similar to the upper rail, the opening of the panel-receiving channel can be approximately the same size as the thickness of the panel to allow for an interference fit between the components.

Figure 6A:
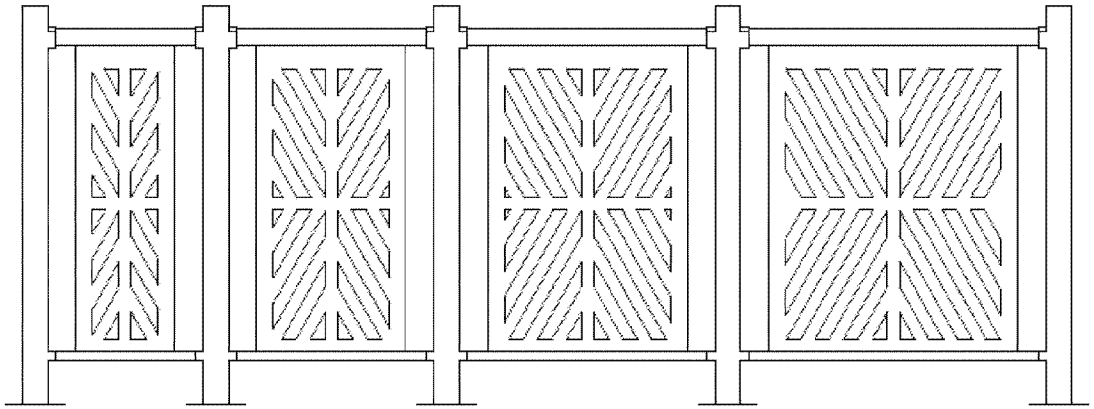
FIGS. 6A and B are schematic diagrams showing exemplary embodiments according to the invention.

FIGS. 6A and B are schematic diagrams showing exemplary embodiments according to the invention. As provided, any number of panel inserts can be used in a railing system according to the invention. Further, any size or shape panel can be used. Even further, multiple panels corresponding to a single rail segment can be used as well. The panels need not be provided as overall rectangle or square patterns and can be configured for use with inclines, such as for use in conjunction with a stair railing system.

Figure 6B:
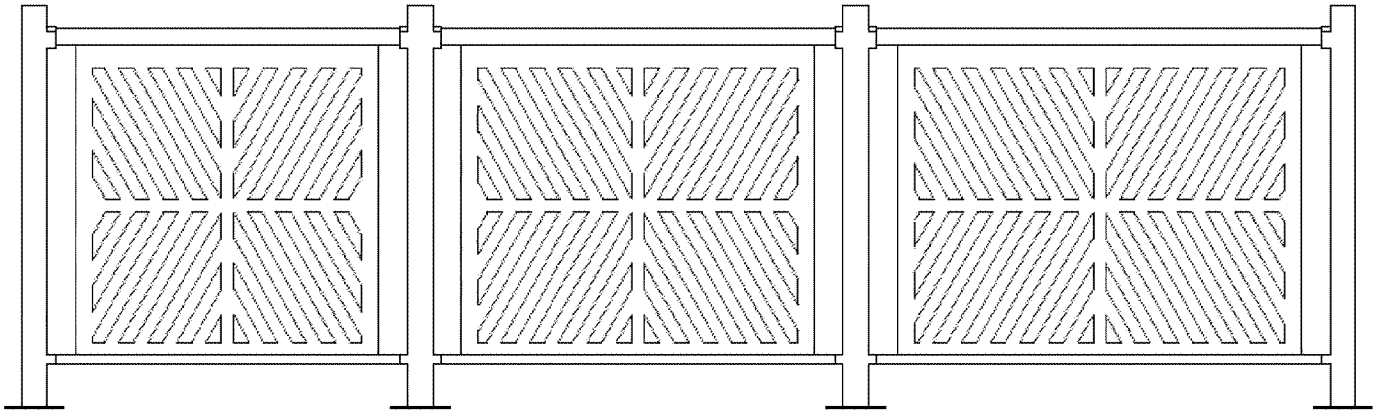

For example, as shown in FIG. 6A, the panels can be configured to provide vertical rectangles in the system. As shown in FIG. 6B, square-shaped panels as well as horizontal rectangles can also be provided. Although one panel for each rail segment is shown in FIGS. 6A and 6B, multiple panels per segment are also possible. For example, instead of four rail segments (FIG. 6A) each containing one panel for a total of four panels, one or more of the four rail segments can contain multiple panels. If four panels are used in each of four rail segments, then the complete railing system would contain sixteen panels. The panel sizes and shapes can also be mixed and/or matched within any one particular railing system.

Further, standard aluminum rails are available in a range of lengths. The panels can be provided as off-the-shelf components to be compatible with such systems. For example, standard lengths for panels of the invention could include any length for accommodation in a railing system where the measurement between the centers of two posts is 16¾$^{th}$ to about 22¾$^{th}$, or 28¾$^{th}$ to 34¾$^{th}$, or 40¾$^{th}$ to 46¾$^{th}$, or 52¾$^{th}$ to 58¾$^{th}$ inches. For example, standard panels may be provided in lengths of 12, 18, 24, 30, 36, 42, 48, and 54 inches for compatibility with the above-mentioned railing lengths.

Numerous cut out configurations for the panels of the invention are possible. FIGS. 7A-F are schematic diagrams of exemplary configurations that can be used. As shown, each of the panel configurations exemplified can be of a standard size, for example, 37⅝$^{th}$ inch in height and 48 inches in length. Another standard size can be 36⅝$^{th}$ by 45¾$^{th}$ inch. Even further, the outer dimensions of the cellular PVC panels can be configured for compatibility with any standard railing system, for example, systems measuring 36 or 42 inches high as measured from the ground (deck, porch, floor, or other surface upon which the system is installed) to the top of the handrail of the railing system when installed.

Figure 7A:
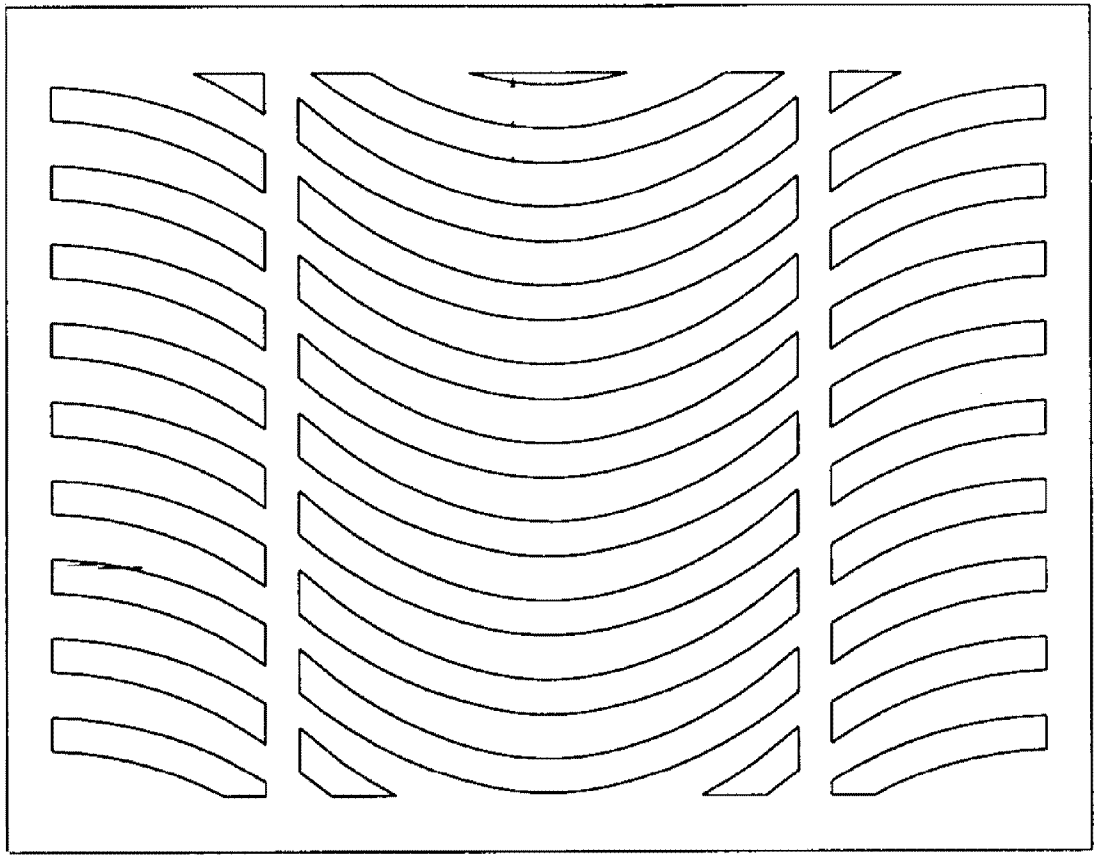
FIGS. 7A-F are schematic diagrams of exemplary inventive panel configurations.
Figure 7B:
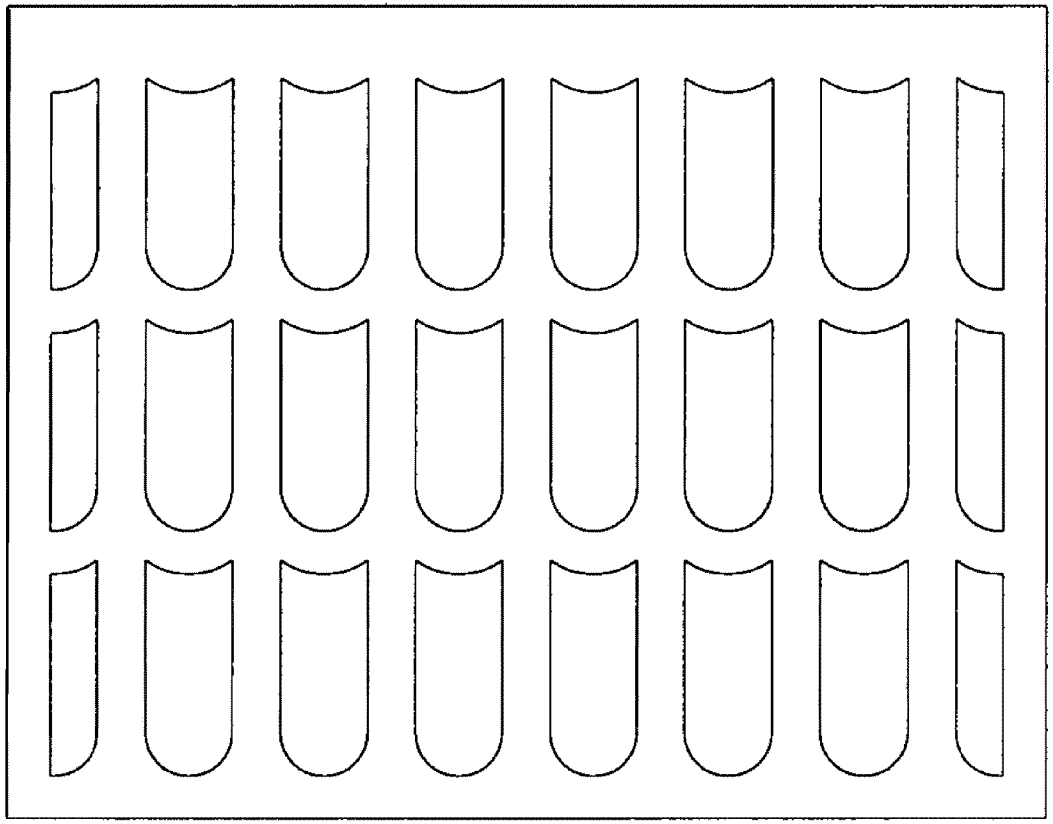
Figure 7C:
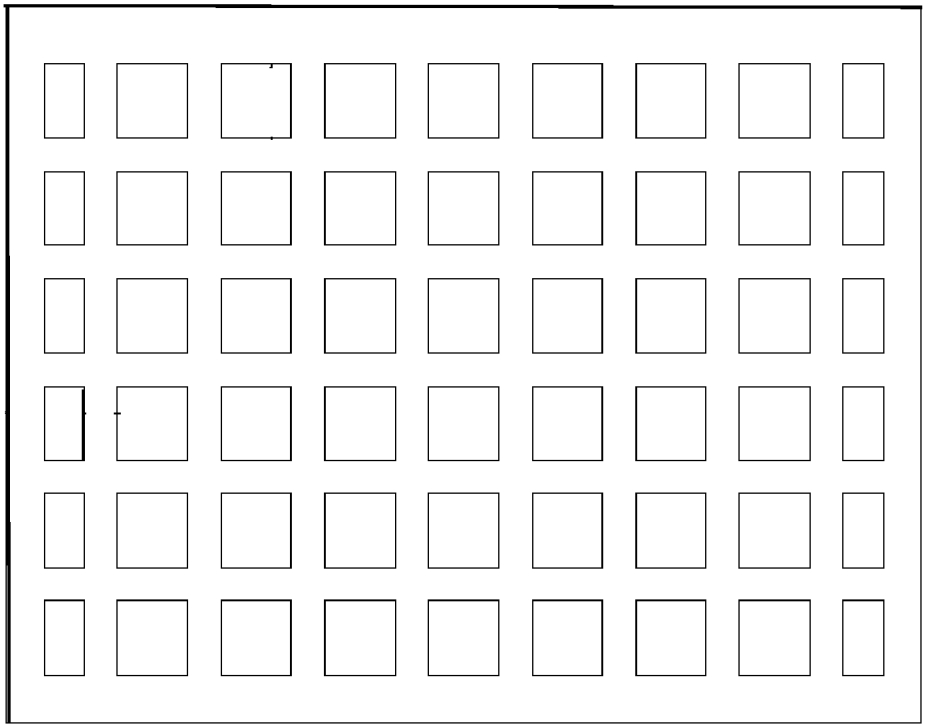
Figure 7D:
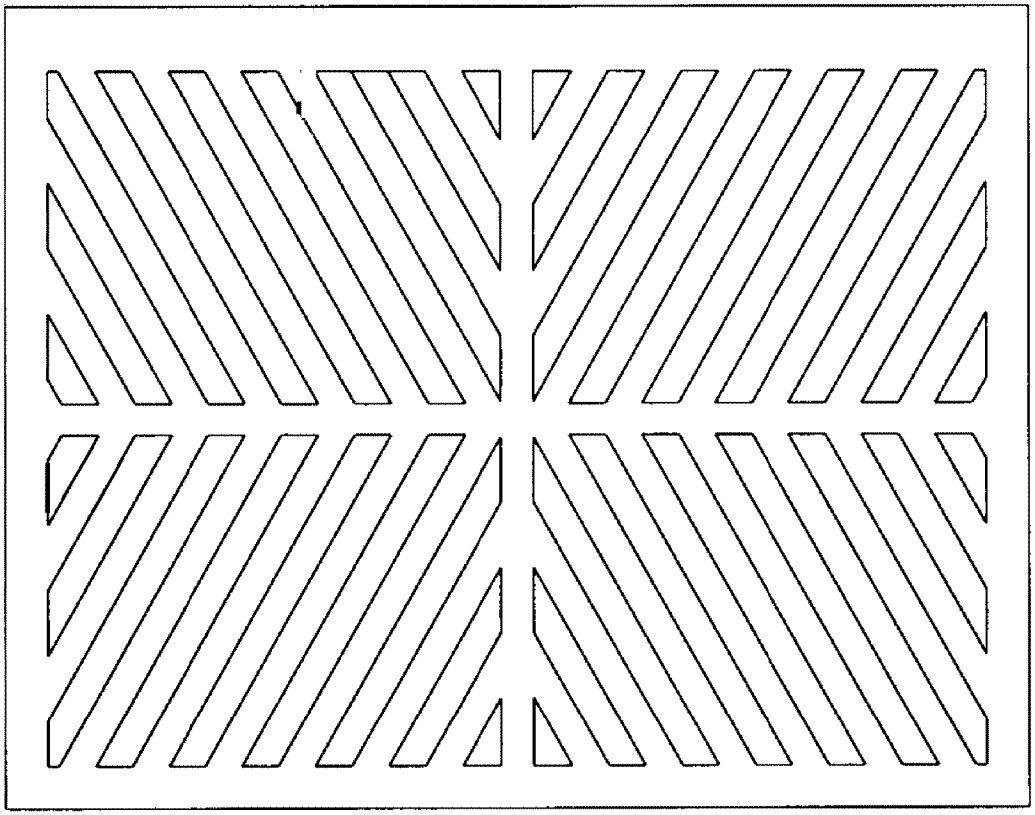
Figure 7E:
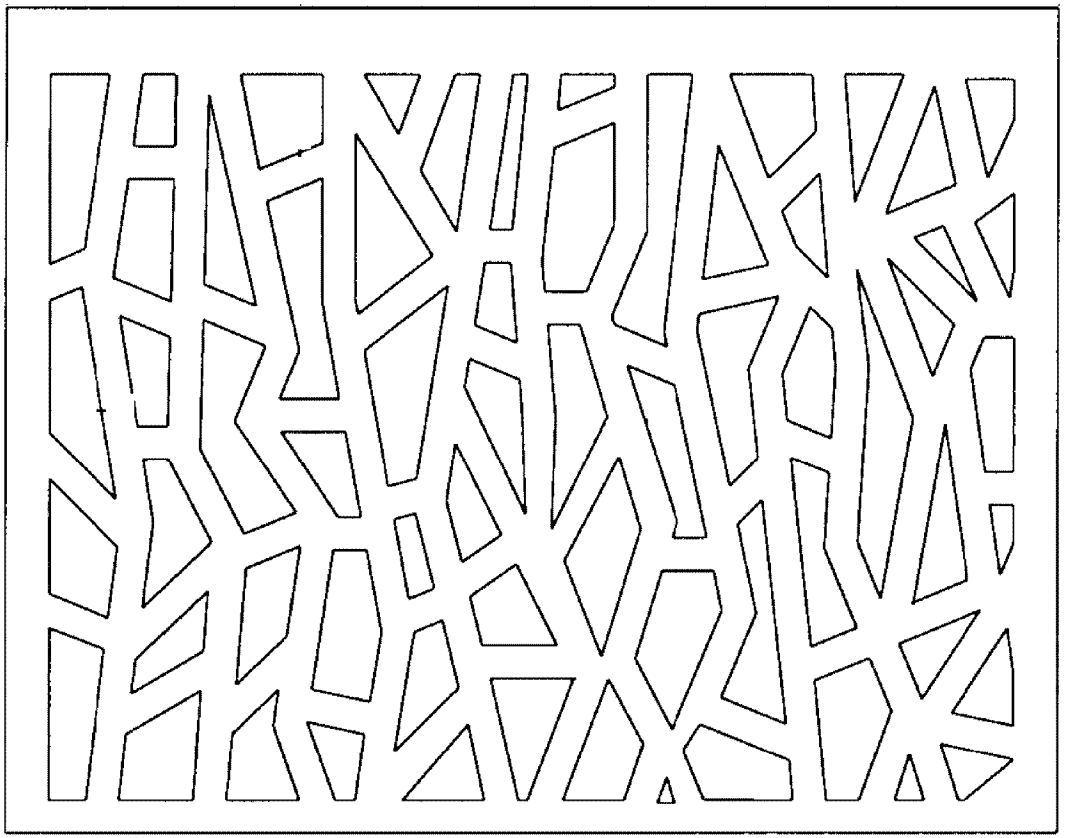
Figure 7F:
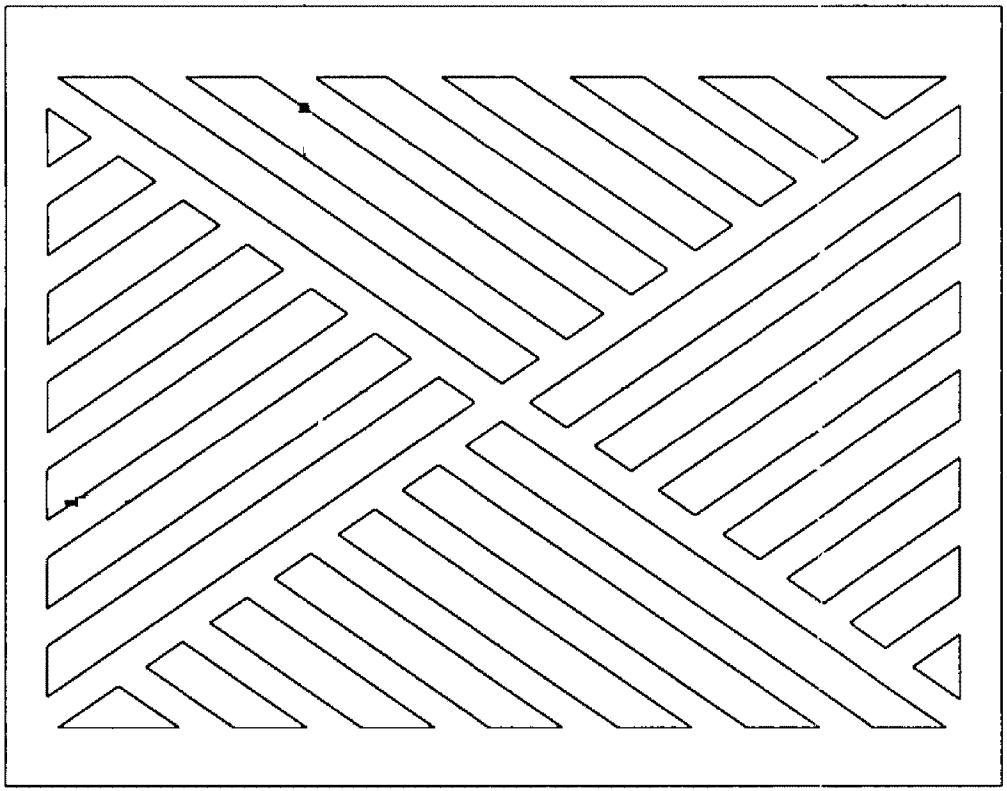
Figure 8:
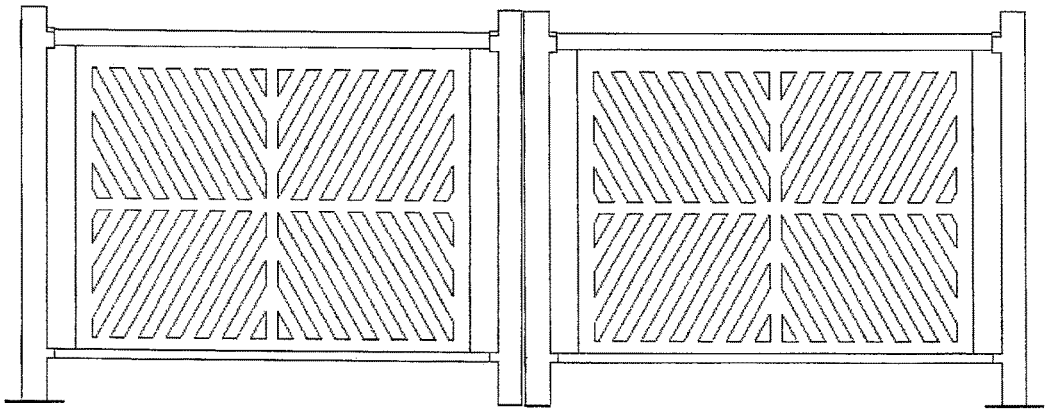
FIG. 8 is a schematic diagram illustrating an exemplary railing system embodiment according to the invention, including two same size PVC panel inserts and upper and lower rails.

In FIG. 7A, a panel measuring 37⅝$^{th}$ by 48 inches comprises voids that make up no more than about 50% of the surface area of the face of the panel shown. More particularly, with these length and height dimensions, if this size panel were a solid piece of cellular PVC, the total surface area of one face of the panel would be about 1800 in$^2$. As with any embodiment described or envisioned herein, the voids can be through holes or routed completely or partially away. The cut outs can be formed by cutting or routing out a particular section of a solid sheet of cellular PVC, or the entire panel can be formed by other processing means, such as by using a molding technique. A routed configuration will generally provide imperfections in the surface appearance of the panel, which can be sanded out, however, such imperfections may be desirable in certain applications, especially where a wood-type look is preferred.

Typically, the panel comprises a section of solid material (i.e., no cut outs) around the perimeter of the panel, otherwise referred to as a frame that is an integral part of the panel. It is not necessary to have a solid perimeter around the panel, but benefits are realized by having such a configuration. For example, the solid perimeter, or integrally-formed frame, provides means for inserting the panel into the upper and lower rails and/or side posts. By providing for an interference fit at one or more of these locations, the overall strength of the railing system can be increased. Further, by providing the frame integral to the panel, i.e., formed as one piece with the overall cut out configuration, strength of the system is additionally increased as compared with panels that may be inserted into a frame, which is then in turn inserted into the railings, as there are fewer joints that could lead to failure during use of the system. In the embodiment shown in FIG. 7A, the integral frame comprises: the section of panel for insertion into the upper railing, which measures about 3 inches along the 48-in. long top edge of the panel, the sections of panel that are about 2 inches wide along the 37⅝$^{th}$ inch height (right and left sides) of the panel, and the bottom section of the panel that is about 2 inches or more along the bottom of the 48-in. bottom edge of the panel, i.e., the section or edge of the panel that would be inserted into a corresponding lower rail.

The portion of the panel devoted to the frame typically makes up or accounts for at least about 5% of the surface area of one face of the panel. Preferably, the frame constitutes about 10%, about 15%, about 20%, or about 25%, or any amount between 10-25% of the surface area of the face of a solid panel (i.e., without routing or cutouts). Said another way, when starting with a desired size panel, e.g., 48×37.5 inches, which has a starting surface area of about 1800 in$^2$ on the front or back face, the surface area of the frame area of the resulting panel (panel with cut out portions) should be at least about 5% (90 in$^2$), 10% (180 in$^2$), and so on.

The cellular PVC material between cut outs in this embodiment is typically larger than about 1 inch, and preferably about 1.1 inch, 1.2 inch, 1.25 inches, 1.3 inches, 1.4 inches, 1½ inches, 2 inches, 2.5 inches, or any width between about ¼ inch to about 4 inches. Indeed, the material between voids (or between voids and the frame) can be any width, whether consistent or inconsistent, ranging from about ¼ inch to about 10 inches. With widths at the lower end of this range or approaching zero, a reduction in system strength may be realized, and may have to be compensated for in another way for certain applications. Although not identified in FIG. 7A, the panel is about ⅝$^{th}$ inch thick. Any thickness of panel and any spacing between cut outs or between cut outs and the frame can be used. Generally, strength of the railing system can be maximized when maximum thicknesses and widths of material are used. Insert panels of the invention may be formed with any suitable dimensions based on the desired application. Typical thicknesses of the panel (which includes panel starting material) will be in the range of about 0.25 inch to about 1 inch. In a particular embodiment suited to existing aluminum channel railing systems, the thickness is about 0.625 in. Thicker panels, for example in the range of about 2-4 inches may also be desired for particular applications. The choice for panel thickness is just one more factor to consider when manufacturing panels capable of withstanding possible pressure loads to be exerted against the panels during use. Also, there is the consideration of cost to factor in as well, as generally thicker panels will require more cellular PVC and increase cost.

Other exemplary panels are provided in FIGS. 7B-F. Each panel is provided with the same outer measurements as the panel of FIG. 7A. Likewise, the voids (whether partial cut outs or total cut outs) of these panels also comprise no more than about 50% of the surface area of the face of the panel shown. Accordingly, in these embodiments the surface area consumed by the cut outs is no more than about 900 sq. in. These panels are also about ⅝$^{th}$ inch thick, but can be made in thinner or thicker versions. The integral frame dimensions of these embodiments are selected such that the surface area of the frame comprises at least 7% or more and up to about 25% of the possible surface area provided before preparing the panel. The cellular PVC material between cut outs (or between cut outs and the integral frame) in these embodiments is typically greater than about 1 inch and no more than about 4 inches, such as about 1½ wide.

The railing systems can be installed as fencing for yards, whether with or without gates; the systems can be installed as interior or exterior railings, such as for example on porches, decks, and/or stairs; and the systems can be installed with or without vertical posts and as gates alone, or any combination of the above. Even further, embodiments of the gates and fence/rail segments can comprise no void between the rails and the panels and/or between the side posts (or other side/vertical support member), for example the integral frame of the panel can be supported on all sides or supported at the top and bottom railing and flush with the exterior surface of the side posts, or flush with the exterior surface of the top/bottom railings and supported within a channel in the vertical posts or side support members.

Figure 9:
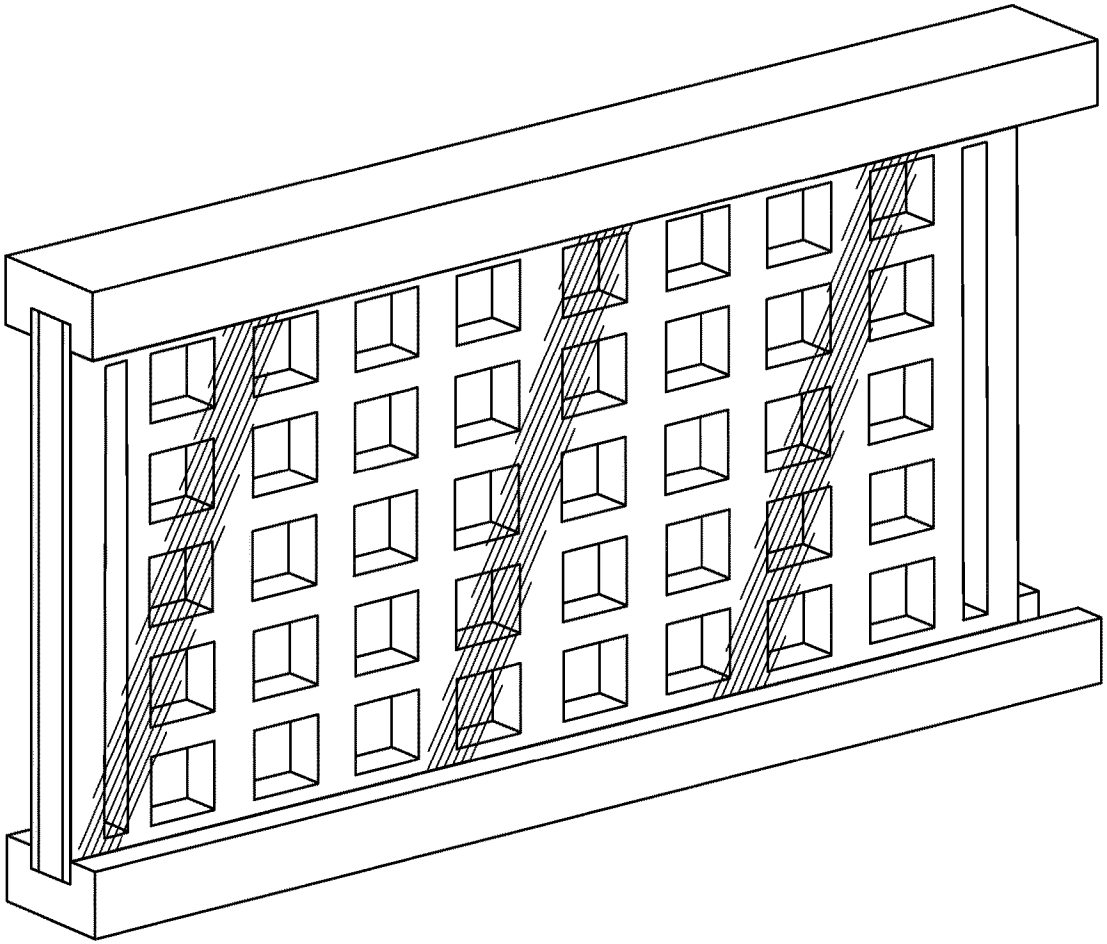
FIG. 9 is a schematic diagram illustrating an exemplary railing system embodiment according to the invention with a PVC panel insert, glass panel, and upper and lower rails.

As shown in FIG. 9, a glass panel can be included with the cellular PVC panels in the railing system embodiments of the invention. Using a cellular PVC panel overlaid with a glass panel can provide railing systems with higher strength than by using glass alone and can provide additional safety features to the cellular PVC panels than if used alone. For example, in some embodiments if used in commercial establishments with balconies (such as hotels), it may be desired to combine a sheet of glass between the building and the side (face) of the cellular PVC panel that faces the building to prevent others, especially children, from climbing the panels. The combination provides a see-through look without causing substantial safety concerns. For additional safety, the glass panel can comprise tempered glass. In preferred embodiments, the panel-receiving channel of the upper and lower rails is capable of accommodating the cellular PVC and glass combination panel and optionally additional material, such as a silicone gasket to protect and secure the glass within the channel.

Some embodiments of the invention may be constructed from pre-formed sheets of PVC or cellular PVC. Cellular PVC manufactured by AZEK® is preferred, which provides the materials by way of a free foam extrusion process to result in a material about half the density of regular PVC. The material is then cooled to form a hard surface layer that resists scratching, and the overall material has a tensile strength of about 2,000 to 5,000 psi. Patterns may be cut in the cellular PVC sheets using a steel bit or water jet. This allows the production of highly intricate and/or customized patterns, yet panels with superior strength. In a particularly effective manufacturing method, the patterns are cut using a CNC machine to produce consistent, repeatable results in a cost-effective manner. Additionally, use of a CNC machine also allows virtually instantaneous changeover from one pattern to another.

The following method is one way to prepare the in-fill panels of the invention:

1. Prepare panel configuration in a computer-based design program, such as AUTOCAD® or similar drawing program.

2. Input computer-based design program data into CNC machine to make cut outs in panel.

3. Load CNC machine with a sheet of solid cellular PVC, secured by vacuum.

4. Start CNC machine and program for cutting material out of the panel.

5. Optionally sand and inspect panel for imperfections.

6. Optionally paint panel.

If desired, the panels can be prepared manually by for example:

1. Prepare panel configuration in a computer-based design program, such as AUTOCAD® or similar drawing program.

2. Print drawing.

3. Using a table saw, cut cellular PVC panel to have the desired outer dimensions of the expected resultant infill panel.

4. Transfer drawing to cut infill panel.

5. Miter cut PVC mouldings to fit configuration of drawing on infill panel.

6. Adhere PVC mouldings with PVC cement to the infill panel.

7. Optionally finish with sanding and/or painting infill panel and overlay.

The above-described manual method can also be modified by using a routing tool to remove sections of the infill panel according to a particular computer-based design program configurationmk. Such tooling will typically provide a panel with a wood-like appearance, which could be desirable for certain applications where the client desires a more sophisticated look. The removed sections in any embodiment herein described can be through holes or cuts that allow for one face of the panel to be cut while leaving the other face intact (partial cut).

Another feasible method of manufacture and more realistic for mass production, is to prepare a die for "stamping" a desired configuration into a solid sheet of cellular PVC. This method is faster than manual or computer-assisted cutting in that the needed configuration is punched into or through the panel using a sharp hole-punch-type tool by forcing the tool against the face of the panel to cut and excise desired voids. This method may also provide cleaner edges where the cutting took place as compared to that of routing or other cutting techniques.

It is possible other materials could be used for the panels, including polystyrene, ABS (acrylonitrile butadiene styrene), polyamides, polypropylene, polyethylene, and polyvinyl chloride (PVC) manufactured with the specified strength needed for a particular application. Even further, such plastics can be re-inforced with short fibers and injection molded as well.

It will be understood that while typical modular railing systems use aluminum rail and support components, the panel inserts of the invention may be used with any modular system using any material including other metals, wood, thermoplastics, etc.

Impact Resistance Verification

The impact resistance tolerance of railing systems of the present invention were tested. In particular, several cellular PVC panel configurations were installed in S.T.A.R.® aluminum guardrail systems and subjected to various loads.

The S.T.A.R.® systems comprised top and bottom rails, vertical posts, and brackets for securing the rails to the posts. The top rails were 2 inches in height and 2-½inches in width and formed from aluminum extrusion. The top rail had a ⅝$^{th}$ inch wide slot (channel) disposed lengthwise along the length of the top rail for receiving the in-fill panel. The top rails measured 47-½inches long for between post systems and 50 inches long for over post systems. The bottom rails measured 1 inch high and 1-½inches wide by 48 inches long are were made from aluminum extrusion. The bottom rails also comprised a ⅝$^{th}$-inch wide panel receiving channel.

The systems comprised brackets for securing the rails to the posts, which were S.T.A.R.® aluminum socket castings. The posts were S.T.A.R.® hollow aluminum extrusions welded to 4-inch square mounting plates —2-¾$^{th}$ inch square for top rail between post systems and 1-¾$^{th}$ inch square for top rail over post systems. One #8 ×½inch Phillips pan washer head plated steel fastener was used to secure the bracket to the rail and three #8 ×1-inch self drilling, Phillips pan washer head plated steel fasteners were used to secure the rail to the panel, at 18-in. to 20-in, on-centers.

Six in-fill panel configurations were independently tested with the S.T.A.R.® aluminum rail guardrail systems. Each panel measured ⅝$^{th}$ inches thick, 45-¾$^{th}$ inches wide, and 36-⅝$^{th}$ inches high. Each panel was constructed of high routed cellular PVC. Additional details about each panel configuration is provided below:

Wave Panel—constructed of approximately nine rows and three columns of approximately 1½ inch wide 12-inch radiused slots (voids, which were through-hole type cut outs). The border or "frame" of the Wave Panel measured 3 inches at the top, 2 inches at the left and right sides, and 1½ inches at the bottom of the panel. The solid portions of material in the panel ranged from about 1.2 to about 2.93 inches wide, with approximately 1¾ inches on average. The ratio of void to solid material in the surface area of this Wave Panel comprised about 50:50 or less.

Waterfall Panel—constructed of approximately three rows and seven columns of approximately 4-inch wide by 9$^{13}$⁄$_{16}$$^{th}$ inch high 2-inch radiused arched voids (through-hole type cut outs). The border or "frame" of the Waterfall Panel measured 2-1$^{5}$⁄$_{16}$$^{th}$ inches at the top, 2¼$^{th}$ inches at the left and right sides, and 2 inches at the bottom of the panel. The solid portions of material in the panel (between voids) measured about 2¼$^{th}$ inches wide. The ratio of void to solid material in the surface area of this Waterfall Panel comprised about 50:50 or less.

Squares Panel—constructed of approximately six rows of seven 3⅞$^{th}$ inch high by 3$^{11}$⁄$_{16}$$^{th}$ inch wide "square" voids (through-hole type cut outs) and two vertical slots measuring 1$^{5}$⁄$_{16}$$^{th}$ inches wide by 32 inches high. The border or "frame" of the Square Panel measured 3 inches at the top, 2 inches at the left and right sides, and 1½ inches at the bottom. The solid portions of material in the panel (between voids) measured about 1$^{13}$⁄$_{16}$$^{th}$ inches wide. The ratio of void to solid material in the surface area of this Squares Panel comprised about 50:50 or less.

Arrow Panel—constructed of approximately four rectangular quadrants containing 1½-inch wide angled slots (through-hole type cut outs). The border or "frame" of the Arrow Panel measured 3 inches at the top and 2 inches at the left, right, and bottom. The solid portions of material in the panel (between voids) measured about 1½ inches wide. The ratio of void to solid material in the surface area of this Arrow Panel is about 50:50 or less.

Stained Glass Panel—constructed of approximately twelve columns of about four irregular shaped voids (through-hole type cut outs). The border or "frame" of the Stained Glass Panel measured 3 inches at the top, 2 inches at the left and right sides, and 1½ inches at the bottom of the panel. The solid portions of material in the panel (between voids) measured about 1½ inches wide. The ratio of void to solid material in the surface area of this Stained Glass Panel is about 50:50 or less.

Chippendale Panel—constructed of approximately four triangular quadrants containing 2-inch wide slots (through-hole type cut outs). The border or "frame" of the Chippendale Panel measured 3¼$^{th}$ inches at the top, 1⅞$^{th}$ inches at the left and right sides, and 2$^{13}$⁄$_{16}$$^{th}$ inches at the bottom of the panel. The solid portions of material in the panel (between voids) measured about 1½ inches wide. The ratio of void to solid material in the surface area of this Chippendale Panel is about 50:50 or less.

The guardrail assemblies were installed and tested as single guardrail sections with end posts secured in rigid vertical stanchions. A transducer mounted to an independent reference frame was located in a position to record movement of the guardrail in-fill panel at the center of load application to determine residual deflection of the panel.

Each test specimen was inspected prior to testing to verify size and general condition of the materials, assembly, and installation. No potentially compromising defects were observed prior to testing. A preload of approximately 50% of design load was applied and released. An initial load of approximately 20% of design load was applied and the transducer was zeroed. Load was then applied at a steady uniform rate until reaching 2.0 times design load in no less than 10 seconds and then released. After allowing a minimum period of one minute for stabilization, load was re-applied to the initial load level used at the start of the loading procedure, and deflections were recorded and used to analyze recovery. Load was then increased at a steady uniform rate until reaching 3.57 times design load or until failure occurred. The testing time was continually recorded from the application of initial test load until the ultimate test load was reached. Measurements were taken and recorded, with all load and displacement measurements taken normal to the rail (horizontal).

Testing results are provided below in Tables 1-6 for each panel. The Design Level (DL) was 50 lb/sq. ft. at the center of the in-fill panel. The Load Level indicates the target test load. The Test Load indicates the actual applied load at the designated load level (target). The Elapsed Time (E.T.) is the amount of time into the test with zero established when the transducers and load cell were zeroed.

TABLE 1

Wave Panel
Test No. 1 - Wave Panel

| Load Level | Test Load (lb) | E.T. (min:sec) | Displacement (in.) |
|---|---|---|---|
| Initial Load | 10 | 00:00 | 0.00 |
| 2.0 × DL (100 lb) | 100 | 00:13-00:14 | 1.74 |
| Initial Load | 10 | 02:51-03:18 | 0.06 |
| 3.6 × DL (180 lb) | 180-182 | 04:18-04:21 | >100% Recovery |

TABLE 2

Waterfall Panel
Test No. 2 - Waterfall Panel

| Load Level | Test Load (lb) | E.T. (min:sec) | Displacement (in.) |
|---|---|---|---|
| Initial Load | 10 | 00:00 | 0.00 |
| 2.0 × DL (100 lb) | 100-102 | 00:22-00:30 | 1.11 |

TABLE 2-continued

Waterfall Panel
Test No. 2 - Waterfall Panel

| Load Level | Test Load (lb) | E.T. (min:sec) | Displacement (in.) |
|---|---|---|---|
| Initial Load | 9-10 | 04:23-05:09 | 0.01 |
| 3.6 × DL (180 lb) | 180-181 | 06:03-06:05 | 99% Recovery |

TABLE 3

Squares Panel
Test No. 3 - Squares Panel

| Load Level | Test Load (lb) | E.T. (min:sec) | Displacement (in.) |
|---|---|---|---|
| Initial Load | 10 | 00:00 | 0.00 |
| 2.0 × DL (100 lb) | 100-104 | 00:27-00:46 | 1.04 |
| Initial Load | 10 | 03:15-03:36 | −0.01 |
| 3.6 × DL (180 lb) | 180-181 | 04:30-04:31 | >100% Recovery |

TABLE 4

Arrow Panel
Test No. 4 - Arrow Panel

| Load Level | Test Load (lb) | E.T. (min:sec) | Displacement (in.) |
|---|---|---|---|
| Initial Load | 10 | 00:00 | 0.00 |
| 2.0 × DL (100 lb) | 102-107 | 00:23-00:42 | 1.11 |
| Initial Load | 10 | 03:12-03:34 | −0.03 |
| 3.6 × DL (180 lb) | 182-187 | 04:09-04:13 | >100% Recovery |

TABLE 5

Stained Glass Panel
Test No. 5 - Stained Glass Panel

| Load Level | Test Load (lb) | E.T. (min:sec) | Displacement (in.) |
|---|---|---|---|
| Initial Load | 10 | 00:00 | 0.00 |
| 2.0 × DL (100 lb) | 100-101 | 00:23-00:24 | 1.09 |
| Initial Load | 10 | 03:27-03:42 | 0.01 |
| 3.6 × DL (180 lb) | 180-185 | 04:16-04:20 | 99% Recovery |

TABLE 6

Chippendale Panel
Test No. 6 - Chippendale Panel

| Load Level | Test Load (lb) | E.T. (min:sec) | Displacement (in.) |
|---|---|---|---|
| Initial Load | 10 | 00:00 | 0.00 |
| 2.0 × DL (100 lb) | 100-101 | 00:25-00:27 | 1.48 |
| Initial Load | 10 | 04:56-05:13 | −0.03 |
| 3.6 × DL (180 lb) | 180-204 | 05:46-05:56 | >100% Recovery |

Using performance criteria of 75% deflection recovery from 2.0 times design load and withstanding an ultimate load of 2.5 times design load (3.6 factor actually used), the test results substantiate compliance of the in-fill panels with the design load requirements of the 2006 International Building Code and the 2006 International Residential Code issued by the International Code Council, which are incorporated by reference herein in their entirety.

In addition, it was observed that the Chippendale Panel in combination with the S.T.A.R.® aluminum railing was capable of withstanding above 360 lb/ft$^2$ of load before being dislodged from the panel-receiving channel of the railing, which is indicative of an extraordinarily strong railing system. Preferred embodiments of the present invention comprise cellular PVC panels capable of resisting forces ranging from about 180-360 lb/ft$^2$ of pressure exerted normal to the panel face at about the center of the panel, without the system failing, which, e.g., could include one or more of the panel popping out of railing, the panel breaking or cracking, the panel bending or otherwise being distorted without returning to a required percentage of its original shape (e.g., recovery rates of 75% or 80% and below could be indicative of failure according to some building codes, while 75% or 80% and above could be passing according to others), or the system otherwise becoming inoperable or in need of repair. Preferred are panels, when installed in railing systems, capable of being subjected to pressures exceeding 200 lb/ft$^2$ and achieving recovery from deflection of 85-100% or more. Especially preferred are such panels that can be subjected to 250-350 lb/ft$^2$ and then recover to 90% or above, 95% or above, 98% or above, 99% or above, or even 100%. It is important to note that any configuration meeting the guidelines specified herein to provide a superior strength railing system can be used and the invention is not limited to the shapes, designs, or patterns of the configurations provided. Indeed, the cellular PVC panels can be cut or formed in any design, including monograms if desired.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. The description of the invention provided is merely exemplary in nature and, thus, variations that do not depart from the essence of the invention are intended to be within the scope of the invention.

The invention claimed is:

1. A modular fencing system comprising:

one or more upright vertical post members;

hollow bodied upper and lower horizontal guardrails with a longitudinal panel-receiving channel having an opening with a width sized for receiving an edge of a panel insert;

one or more panel inserts comprising:

a solid sheet of cellular polyvinyl chloride (PVC) with four panel edges, a front surface, and a back surface;

the four panel edges comprising planar upper and lower edges the same width or smaller than the width of the panel-receiving channels;

the front surface or the back surface having partial or complete voids in or through the panel insert, which collectively account for less than about 50% of the front surface or the back surface measured by surface area;

a planar border disposed around a perimeter of each of the front surface and the back surface, wherein in an area between one of the panel edges and one of the voids the planar border is disposed in a single plane; and wherein, upon installation in the guardrails and upon receiving a load normal to a panel insert at its center sufficient to displace the panel 1 inch or greater, the panel exhibits recovery from displacement of 95% or higher.

2. The modular fencing system of claim 1, wherein the posts and upper and lower guardrails comprise aluminum, wood, plastic, vinyl, composites, vinyl with aluminum reinforcement, cellular PVC, or combinations thereof.

3. The modular fencing system of claim 1, wherein the posts and upper and lower guardrails comprise aluminum having a minimum tensile strength of about 38,000 psi.

4. The modular fencing system of claim 3, wherein the panel inserts comprise cellular PVC with a tensile strength of about 2,000 to 5,000 psi.

5. The modular fencing system of claim 1, wherein the panel inserts comprise cellular PVC with a tensile strength of about 2,000 to 5,000 psi.

6. The modular fencing system of claim 1, further comprising a tempered glass panel insert in addition to the cellular PVC panel insert, which together comprise the same width or smaller than the width of the panel-receiving channels of the guardrails.

7. The modular fencing system of claim 1 comprising two or more panels of the same size.

8. The modular fencing system of claim 7, wherein all panels have the same length which is chosen from 12, 18, 24, 30, 36, 42, or 48 inches.

9. The modular fencing system of claim 1, wherein the voids in the panel inserts are cutouts.

10. The modular fencing system of claim 1, wherein the panel insert is a Wave Panel, constructed of approximately nine rows and three columns of approximately 1-½ inch wide 12-inch radiused cutouts.

11. The modular fencing system of claim 1, wherein the panel insert is a Waterfall Panel, constructed of approximately three rows and seven columns of approximately 4-inch wide by 9-$^{13}/_{16}$$^{th}$ inch high 2-inch radiused arched cutouts.

12. The modular fencing system of claim 1, wherein the panel insert is a Squares Panel, constructed of approximately six rows of seven 3-$^{7}/_{8}$$^{th}$ inch high by 3-$^{11}/_{16}$$^{th}$ inch wide "square" cutouts and two vertical cutouts measuring $^{15}/_{16}$$^{th}$ inches wide by 32 inches high.

13. The modular fencing system of claim 1, wherein the panel insert is an Arrow Panel, constructed of approximately four rectangular quadrants containing 1-½-inch wide angled cutouts.

14. The modular fencing system of claim 1, wherein the panel insert is a Stained Glass Panel, constructed of approximately twelve columns of about four irregular shaped cutouts.

15. The modular fencing system of claim 1, wherein the panel insert is a Chippendale Panel, constructed of approximately four triangular quadrants containing 2-inch wide cutouts.

16. The modular fencing system of claim 1, wherein the planar border is at least a 1-inch wide border of cellular PVC around the perimeter of the panel insert.

17. The modular fencing system of claim 1, wherein the panel insert comprises a thickness of $^{5}/_{16}$ inch to 1 inch.

* * * * *